US010151291B2

(12) United States Patent
Ikeda

(10) Patent No.: US 10,151,291 B2
(45) Date of Patent: Dec. 11, 2018

(54) INTERNAL COMBUSTION ENGINE

(71) Applicant: IMAGINEERING, Inc., Kobe-shi, Hyogo (JP)

(72) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 435 days.

(21) Appl. No.: 14/156,068

(22) Filed: Jan. 15, 2014

(65) Prior Publication Data

US 2014/0196679 A1 Jul. 17, 2014

Related U.S. Application Data

(63) Continuation of application No. PCT/JP2012/068010, filed on Jul. 13, 2012.

(30) Foreign Application Priority Data

Jul. 16, 2011 (JP) ..... 2011-157285
Aug. 10, 2011 (JP) ..... 2011-175394

(51) Int. Cl.
*F02P 19/00* (2006.01)
*F02P 3/01* (2006.01)
(Continued)

(52) U.S. Cl.
CPC ..... *F02P 19/00* (2013.01); *F02P 3/01* (2013.01); *F02P 23/04* (2013.01); *H05H 1/46* (2013.01); *H05H 2001/463* (2013.01)

(58) Field of Classification Search
CPC ..... F02M 27/00; F02M 27/04; F02M 27/042; F02M 27/08
(Continued)

(56) References Cited

U.S. PATENT DOCUMENTS 4,138,980 A * 2/1979 Ward ..... 123/536
4,403,504 A * 9/1983 Krage et al. ..... 73/114.29
(Continued)

FOREIGN PATENT DOCUMENTS

JP 2001-501699 A 2/2001
JP 2007-113570 A 5/2007
(Continued)

OTHER PUBLICATIONS

International Search Report dated Nov. 20, 2012, issued in corresponding application No. PCT/JP2012/068011.

*Primary Examiner* — Hieu T Vo
*Assistant Examiner* — Sherman Manley
(74) *Attorney, Agent, or Firm* — Westerman, Hattori, Daniels & Adrian, LLP

(57) ABSTRACT

To improve a propagation speed of a flame by effectively utilizing energy of the electromagnetic wave in the combustion chamber in an internal combustion engine that promotes combustion of fuel air mixture in a combustion chamber by means of an electromagnetic wave. The internal combustion engine includes, in addition to an internal combustion engine main body and an ignition device, an electromagnetic wave emission device and a control device. The electromagnetic wave emission device emits an electromagnetic wave to the combustion chamber while the flame is being propagated after ignition of the fuel air mixture. The control device controls a frequency of the electromagnetic wave emitted to the combustion chamber in view of a resonant frequency of the combustion chamber in accordance with an operation condition of the internal combustion engine main body or a propagation condition of the flame.

2 Claims, 5 Drawing Sheets

(51) Int. Cl.
*F02P 23/04* (2006.01)
*H05H 1/46* (2006.01)

(58) Field of Classification Search
USPC ..... 123/143 B, 536
See application file for complete search history.

(56) References Cited

U.S. PATENT DOCUMENTS

| | | | | |
|---|---|---|---|---|
| 4,492,114 | A * | 1/1985 | Yamanaka et al. | 73/114.64 |
| 6,581,581 | B1 * | 6/2003 | Bebich | 123/536 |
| 7,793,632 | B2 * | 9/2010 | Idogawa et al. | 123/169 R |
| 8,240,293 | B2 * | 8/2012 | Ikeda | 123/536 |
| 2009/0229581 | A1 * | 9/2009 | Ikeda | 123/536 |
| 2012/0239274 | A1 * | 9/2012 | Ikeda | 701/102 |

FOREIGN PATENT DOCUMENTS

| | | | | |
|---|---|---|---|---|
| JP | 2009-103038 | A | | 5/2009 |
| JP | 2009103038 | A | * | 5/2009 |
| JP | 2011-132900 | A | | 7/2011 |

* cited by examiner

INTERNAL COMBUSTION ENGINE

TECHNICAL FIELD

The present invention relates to an internal combustion engine that promotes combustion of a fuel air mixture in a combustion chamber utilizing an electromagnetic wave.

BACKGROUND ART

Conventionally, there is known an internal combustion engine that promotes combustion of a fuel air mixture in a combustion chamber utilizing an electromagnetic wave.

Japanese Unexamined Patent Application, Publication No. 2007-113570 discloses an internal combustion engine that includes an ignition device that causes a plasma discharge by emitting a microwave to a combustion chamber before or after ignition of a fuel air mixture. The ignition device generates local plasma using a discharge by an ignition plug so that the plasma is generated in a high pressure field, and grows the plasma using the microwave. The local plasma is generated at a discharge gap between a tip end part of an anode terminal and a ground terminal part.

THE DISCLOSURE OF THE INVENTION

Problems to Be Solved by the Invention

In an internal combustion engine, a resonant frequency of a combustion chamber varies depending on an operation condition of the internal combustion engine and a propagation condition of a flame after the ignition of a fuel air mixture. Therefore, in a conventional internal combustion engine, a propagation speed of the flame may not be improved adequately when an electromagnetic wave is emitted to a combustion chamber during a propagation of the flame.

The present invention has been made in view of the above described circumstances, and it is an object of the present invention to improve a propagation speed of a flame by effectively utilizing energy of an electromagnetic wave in a combustion chamber in an internal combustion engine that promotes combustion of a fuel air mixture in the combustion chamber using the electromagnetic wave.

Means for Solving the Problems

In accordance with a first aspect of the present invention, there is provided an internal combustion engine including an internal combustion engine main body formed with a combustion chamber, and an ignition device igniting fuel air mixture in the combustion chamber, wherein a repetitive combustion cycle including an ignition of fuel air mixture by the ignition device ignites and combustion of fuel air mixture is executed therein. The internal combustion engine includes: an electromagnetic wave emission device that emits an electromagnetic wave to the combustion chamber during a propagation of a flame following the ignition of the fuel air mixture; and a control unit that controls a frequency of the electromagnetic wave emitted to the combustion chamber from the electromagnetic wave emission device in view of a resonant frequency of the combustion chamber in accordance with an operation condition of the internal combustion engine main body.

According to the first aspect of the present invention, the frequency of the electromagnetic wave emitted to the combustion chamber is controlled in view of the resonant frequency of the combustion chamber in accordance with the operation condition of the internal combustion engine main body. Accordingly, the electromagnetic wave emitted to the combustion chamber properly resonates while the flame is being propagated. In a case in which the plasma grown by the electromagnetic wave is located distant from the electromagnetic wave emission device, even a slight variation in resonant frequency of the combustion chamber in accordance with the operation condition of the internal combustion engine main body will exert a great influence on the plasma. On the contrary, in a case in which the plasma is located close to the electromagnetic wave emission device, such a variation will hardly exert an influence. Therefore, depending on the location relationship between the plasma and the electromagnetic wave emission device, the resonant frequency may be considered only as a guide.

In accordance with a second aspect of the present invention, there is provided an internal combustion engine including an internal combustion engine main body formed with a combustion chamber, and an ignition device igniting fuel air mixture in the combustion chamber, wherein a repetitive combustion cycle including an ignition of fuel air mixture by the ignition device and combustion of the fuel air mixture is executed therein. The internal combustion engine includes: an electromagnetic wave emission device that emits an electromagnetic wave to the combustion chamber during a propagation of a flame following the ignition of the fuel air mixture; and a control device that controls a frequency of the electromagnetic wave emitted to the combustion chamber from the electromagnetic wave emission device in view of a resonant frequency of the combustion chamber in accordance with a propagation condition of the flame.

According to the second aspect of the present invention, the frequency of the electromagnetic wave emitted to the combustion chamber is controlled in view of the resonant frequency of the combustion chamber in accordance with the propagation condition of the flame. Accordingly, the electromagnetic wave emitted to the combustion chamber properly resonates while the flame is being propagated.

Effects of the Invention

According to the present invention, it is configured such that the frequency of the electromagnetic wave emitted to the combustion chamber is controlled in view of the resonant frequency of the combustion chamber so that the electromagnetic wave properly resonates in the combustion chamber while the flame is being propagated. Accordingly, it is possible to improve the propagation speed of the flame effectively utilizing the energy of the electromagnetic wave in the combustion chamber.

BEST MODE FOR CARRYING OUT THE INVENTION

Figure 1:
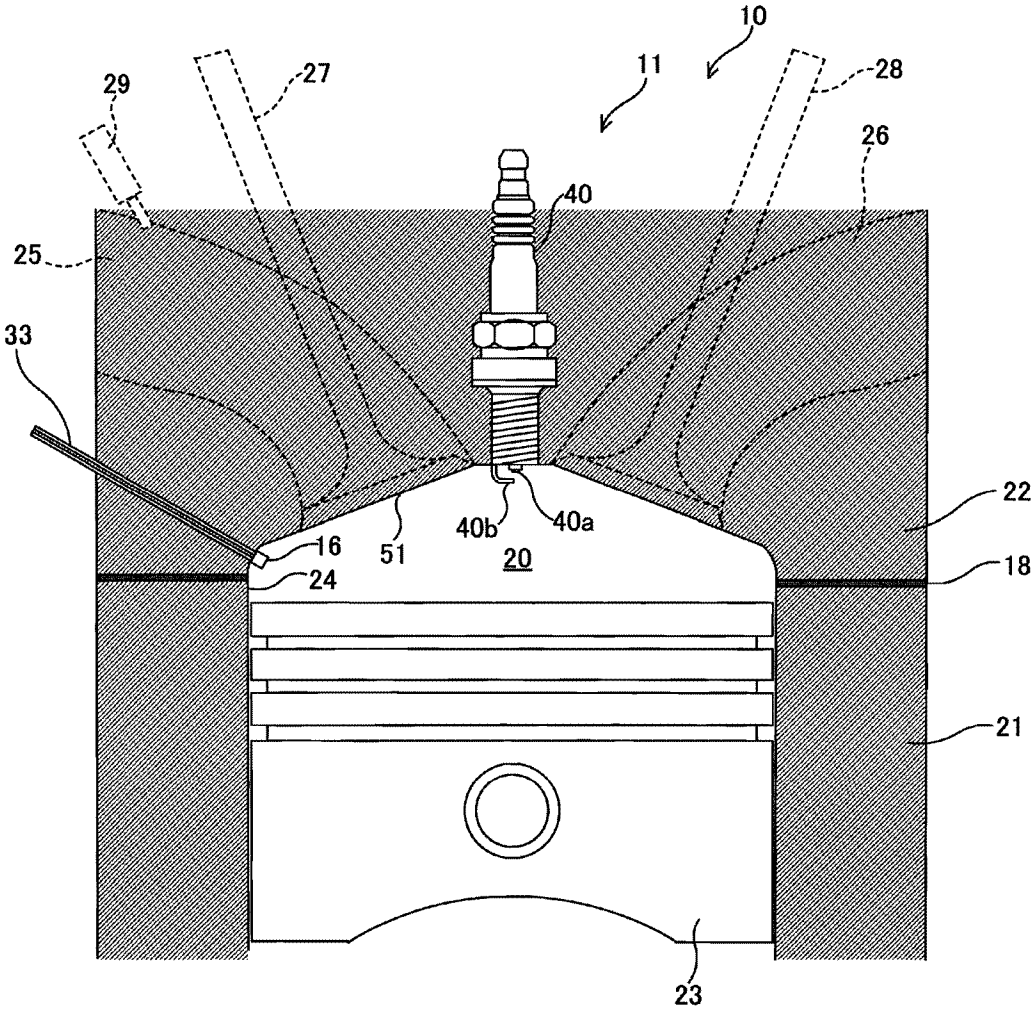
FIG. 1 is a vertical cross sectional view of an internal combustion engine according to an embodiment.

In the following, a detailed description will be given of an embodiment of the present invention with reference to drawings. It should be noted that the following embodiment is merely a preferable example, and does not limit the scope of the present invention, applied field thereof, or application thereof.

The present embodiment is directed to an internal combustion engine 10 according to the present invention. The internal combustion engine 10 is a reciprocating type internal combustion engine in which pistons 23 reciprocate. The internal combustion engine 10 includes an internal combustion engine main body 11, an ignition device 12, an electromagnetic wave emission device 13, and a control device 35. In the internal combustion engine 10, a combustion cycle, in which the ignition device 12 ignites and combusts fuel air mixture, is repeated.

<Internal Combustion Engine Main Body>

As shown in FIG. 1, the internal combustion engine main body 11 is provided with a cylinder block 21, a cylinder head 22, and the pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The cylinder head 22 constitutes a partitioning member that partitions a combustion chamber 20 having a circular cross section, along with the cylinder 24, the piston 23, and the gasket 18. A diameter of the combustion chamber 20 is approximately equal to a half wavelength of the microwave emitted to the combustion chamber 20 by the electromagnetic wave emission device 13.

Figure 2:
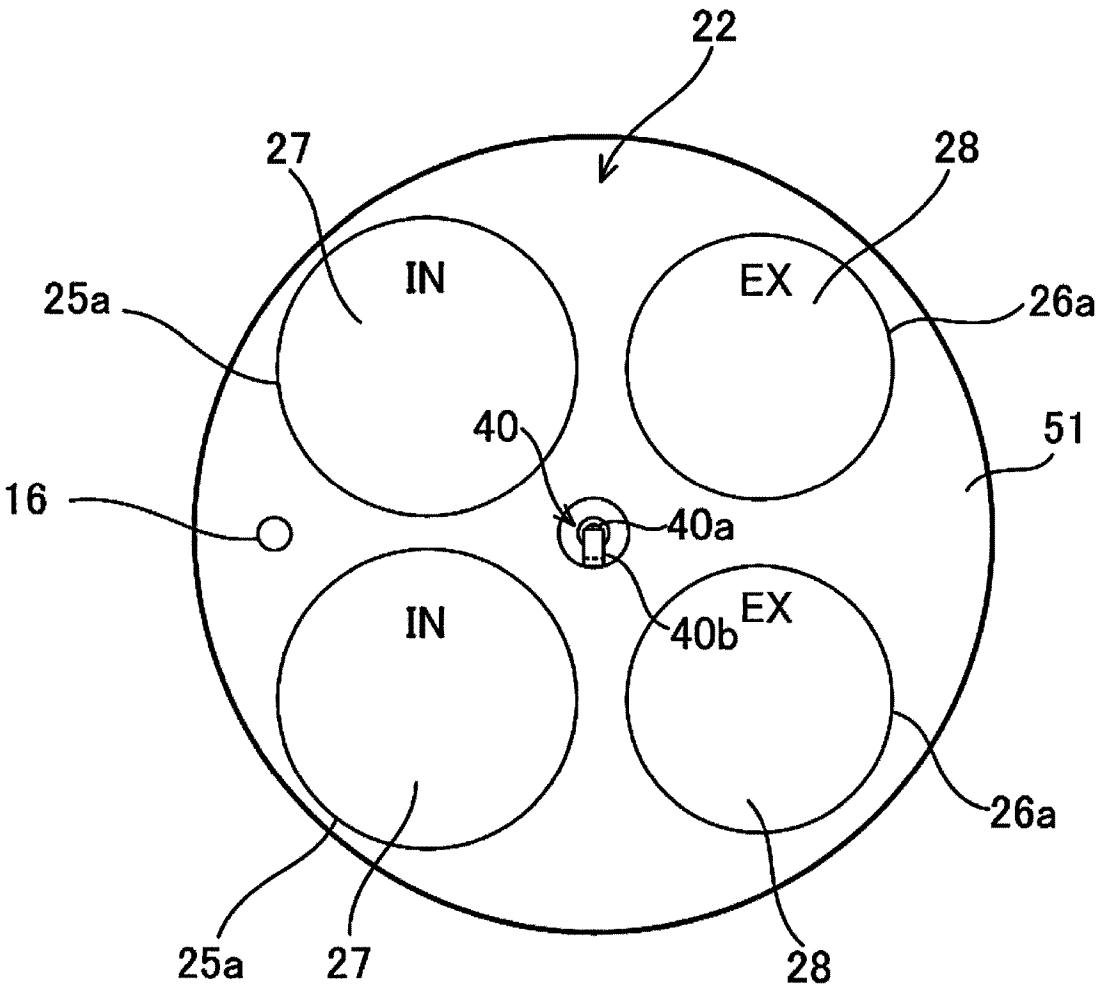
FIG. 2 is a front view of a ceiling surface of a combustion chamber of the internal combustion engine according to the embodiment.

The cylinder head 22 is provided with one ignition plug 40 that constitutes a part of the ignition device 12 for each cylinder 24. As shown in FIG. 2, the ignition plug 40 locates at a central part of a ceiling surface 51 of the combustion chamber 20. The surface 51 is a surface of the cylinder head 22 and exposed toward the combustion chamber 20. An outer periphery of a tip end part of the ignition plug 40 is circular viewed from an axial direction of the ignition plug 40. The ignition plug 40 is provided with a central electrode 40*a* and a ground electrode 40*b* at the tip end part of the ignition plug 40. A discharge gap is formed between a tip end of the central electrode 40*a* and a tip end of the ground electrode 40*b*.

The cylinder head 22 is formed with intake ports 25 and exhaust ports 26 for each cylinder 24. Each intake port 25 is provided with an intake valve 27 for opening and closing an intake side opening 25*a* of the intake port 25, and an injector 29 for injecting fuel. On the other hand, each exhaust port 26 is provided with an exhaust valve 28 for opening and closing an exhaust side opening 26*a* of the exhaust port 26. The internal combustion engine 10 is designed such that the intake ports 25 form a strong tumble flow in the combustion chamber 20.

<Ignition Device>

Figure 3:
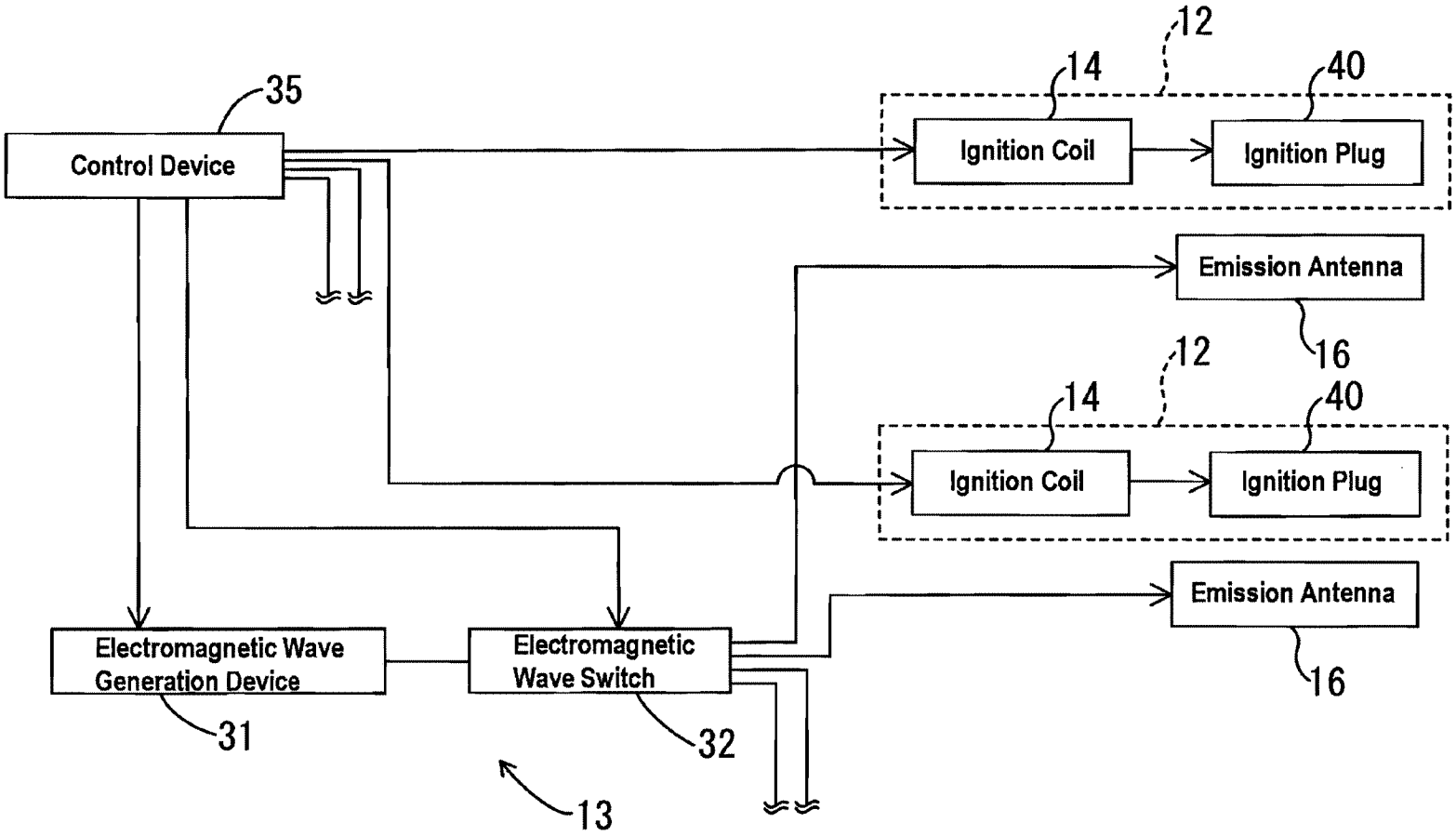
FIG. 3 is a block diagram of an ignition device and an electromagnetic wave emission device according to the embodiment.

The ignition device 12 is provided for each combustion chamber 20. As shown in FIG. 3, each ignition device 12 includes an ignition coil 14 that outputs a high voltage pulse, and an ignition plug 40 which the high voltage pulse outputted from the ignition coil 14 is supplied to.

The ignition coil 14 is connected to a direct current power supply (not shown). The ignition coil 14, upon receiving an ignition signal from the control device 35, boosts a voltage applied from the direct current power supply, and outputs the boosted high voltage pulse to the central electrode 40*a* of the ignition plug 40. The ignition plug 40, when the high voltage pulse is applied to the central electrode 40*a*, causes an insulation breakdown and a spark discharge to occur at the discharge gap. Along a discharge path of the spark discharge, discharge plasma is generated. The central electrode 40*a* is applied with a negative voltage as the high voltage pulse.

The ignition device 12 may include a plasma enlarging part that enlarges the discharge plasma by supplying the discharge plasma with electric energy. The plasma enlarging part enlarges the spark discharge, for example, by supplying the spark discharge with energy of a high frequency such as a microwave. By means of the plasma enlarging part, it is possible to improve stability of ignition even for a lean fuel air mixture. The electromagnetic wave emission device 13 may be utilized as the plasma enlarging part.

<Electromagnetic Wave Emission Device>

As shown in FIG. 3, the electromagnetic wave emission device 13 includes an electromagnetic wave generation device 31, an electromagnetic wave switch 32, and an emission antenna 16. One electromagnetic wave generation device 31 and one electromagnetic wave switch 32 are provided for the electromagnetic wave emission device 13, and the emission antenna 16 is provided for each combustion chamber 20.

The electromagnetic wave generation device 31, upon receiving an electromagnetic wave drive signal from the control device 35, repeatedly outputs a microwave pulse at a predetermined duty cycle. The electromagnetic wave drive signal is a pulse signal. The electromagnetic wave generation device 31 repeatedly outputs the microwave pulse during a period of time of the pulse width of the electromagnetic wave drive signal. In the electromagnetic wave generation device 31, a semiconductor oscillator generates the microwave pulse. In place of the semiconductor oscillator, any other oscillator such as a magnetron may be employed.

The electromagnetic wave switch 32 includes an input terminal and a plurality of output terminals provided for respective emission antennae 16. The input terminal is connected to the electromagnetic wave generation device 31. Each output terminal is connected to the corresponding emission antenna 16. The electromagnetic wave switch 32 switches a supply destination of the microwave outputted from the electromagnetic wave generation device 31 in turn from among the plurality of emission antennae 16 under a control of the control device 35.

Figure 4:
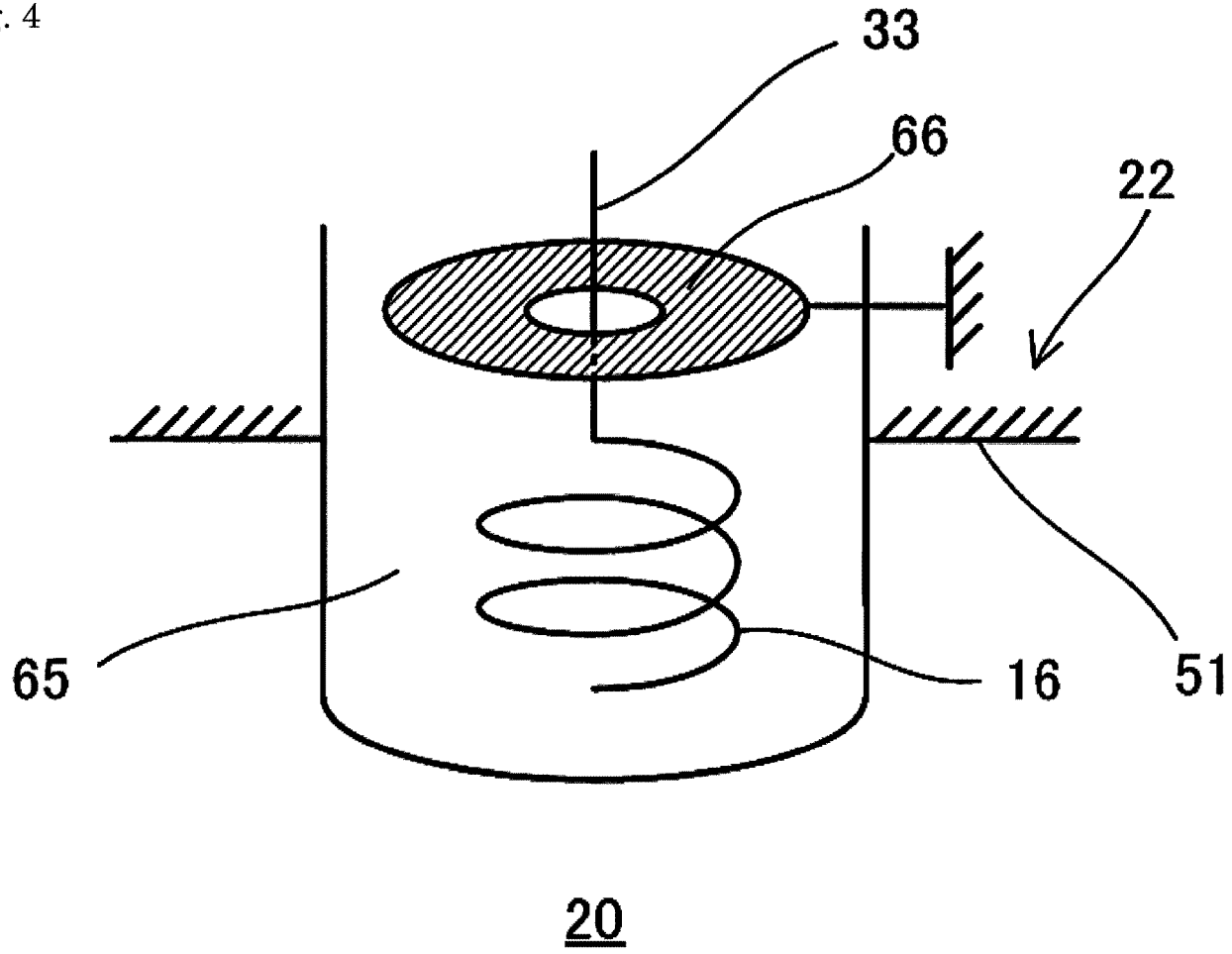
FIG. 4 is a schematic configuration diagram of an emission antenna according to the embodiment.

The emission antenna 16 is provided on the ceiling surface 51 of the combustion chamber 20. The emission antenna 16 is provided in a region between the two intake side openings 25*a*. As shown in FIG. 1, the emission antenna 16 is protruded from the ceiling surface 51 of the combustion chamber 20. As shown in FIG. 4, the emission antenna 16 is formed in a helical shape and embedded in an insulator 65. A length of the emission antenna 16 is equal to a quarter wavelength of the microwave on the corresponding emission antenna 16. The emission antenna 16 is electrically connected to the output terminal of the electromagnetic wave switch 32 via a transmission line 33 embedded in the cylinder head 22.

According to the present embodiment, the electromagnetic wave emission device 13 is configured to be capable of adjusting a frequency of the microwave emitted to the combustion chamber 20 from the emission antenna 16. More particularly, the electromagnetic wave generation device 31 is configured to be capable of adjusting an oscillation frequency of the microwave. For example, assuming that a central value f of the oscillation frequency is 2.45 GHz, the electromagnetic wave generation device 31 is configured to be capable of continuously adjusting the oscillation frequency between a first set value f1 (f1=f−X) on a low frequency side and a second set value f2 (f2=f+X) on a high frequency side. Wherein X is a value between several Hz and several tens of Hz. X may be, for example, 10 Hz.

The electromagnetic wave emission device 13 may include a plurality of the electromagnetic wave generation devices 31 respectively having oscillation frequencies different from one another, and adjust the frequency of the microwave to be emitted to the combustion chamber 20 by switching the electromagnetic wave generation device 31 to be used from among the electromagnetic wave generation devices 31.

<Operation of Control Device>

An operation of the control device 35 will be described hereinafter. The control device 35 performs a first operation of instructing the ignition device 12 to ignite the fuel air mixture and a second operation of instructing the electromagnetic wave emission device 13 to emit the microwave after the ignition of the fuel air mixture, for each combustion chamber 20 during one combustion cycle.

More particularly, the control device 35 performs the first operation at an ignition timing at which the piston 23 locates immediately before the compression top dead center. The control device 35 outputs the ignition signal as the first operation.

The ignition device 12, upon receiving the ignition signal, causes the spark discharge to occur at the discharge gap of the ignition plug 40, as described above. The fuel air mixture is ignited by the spark discharge. When the fuel air mixture is ignited, the flame spreads from an ignition location of the fuel air mixture at a central part of the combustion chamber 20 toward a wall surface of the cylinder 24.

The control device 35 performs the second operation after the ignition of the fuel air mixture, for example, at a start timing of a latter half period of flame propagation. The control device 35 outputs the electromagnetic wave drive signal as the second operation.

The electromagnetic wave emission device 13, upon receiving the electromagnetic wave drive signal, causes the emission antenna 16 to repeatedly emit the microwave pulse, as described above. The microwave pulse is repeatedly emitted during the latter half period of the flame propagation.

According to the present embodiment, the control device 35 constitutes a control unit that controls the frequency of the microwave emitted by the electromagnetic wave emission device 13 to the combustion chamber 20 in view of the resonant frequency of the combustion chamber 20 in accordance with the operation condition of the internal combustion engine main body 11. The control device 35 controls the oscillation frequency of the electromagnetic wave generation device 31 for the purpose of controlling the frequency of the microwave emitted by the electromagnetic wave emission device 13 to the combustion chamber 20.

The control device 35 is provided with a control map for acquiring a target value of the oscillation frequency, which is predetermined between the first set value f1 and the second set value f2, as an output value when a load and a rotation speed of the internal combustion engine main body 11 are inputted as input values. The control map has been prepared in view of the resonant frequency of the combustion chamber 20 in accordance with the operation condition of the internal combustion engine main body 11. For example, in the control map, the target value of the oscillation frequency is configured to increase as the operation condition moves from a low load and a low rotation speed regions toward a high load and a high rotation speed regions. The control device 35, when the load and the rotation speed of the internal combustion engine main body 11 are inputted, reads the target value of the oscillation frequency from the control map, and sets the oscillation frequency of the electromagnetic wave generation device 31 to be the target value. Thus, the microwave of the frequency in view of the resonant frequency of the combustion chamber 20 is emitted to the combustion chamber 20. Accordingly, since the microwave properly resonates in the combustion chamber 20 during the flame propagation, the propagation speed of the flame is effectively improved. Furthermore, the permittivity of the combustion chamber 20 varies in accordance with the operation condition of the internal combustion engine main body 11. Accordingly, by setting target values of the oscillation frequency in accordance with respective permittivities in the control map, measuring the permittivity in the combustion chamber 20, and inputting the permittivity thus measured to the control device 35, it is possible to set the oscillation frequency of the electromagnetic wave generation device 31 to the target value.

In a case in which the microwave energy is high, microwave plasma is generated in a strong electric field region of the combustion chamber 20. In a region where the microwave plasma is generated, active species such as OH radicals are generated. The propagation speed of the flame increases as the flame passes through the strong electric field region owing to the active species.

<Effect of Embodiment>

According to the present embodiment, it is configured such that the frequency of the microwave emitted to the combustion chamber 20 is controlled in view of the resonant frequency of the combustion chamber 20 so that the microwave properly resonates in the combustion chamber 20 during the flame propagation. Accordingly, it is possible to improve the propagation speed of the flame by effectively utilizing the energy of the microwave in the combustion chamber 20.

<First Modified Example of Embodiment>

According to the first modified example of the present embodiment, the control device 35 constitutes a control unit that controls the frequency of the microwave emitted by the electromagnetic wave emission device 13 to the combustion chamber 20 in view of the resonant frequency of the combustion chamber 20 in accordance with a propagation condition of the flame. The control device 35 controls the oscillation frequency of the electromagnetic wave generation device 31 for the purpose of controlling the frequency of the microwave emitted by the electromagnetic wave emission device 13 to the combustion chamber 20.

The control device 35 estimates as to what extent the flame has spread at a start time of the microwave emission based on a time difference between an execution timing of the first operation (an ignition timing of the fuel air mixture by the ignition device 12) and a start timing of the second operation (a start timing of the microwave emission by the electromagnetic wave emission device 13), and determines the target value of the oscillation frequency based on the estimated result. For example, as the time difference is larger between the execution timing of the first operation and the start timing of the second operation, the control device 35 estimates that the flame has spread across a wider area at the start time of the microwave emission, and sets the target value of the oscillation frequency to a larger value.

The control device 35, after setting the target value of the oscillation frequency, sets the oscillation frequency of the electromagnetic wave generation device 31 to the target value. Thus, the microwave of a frequency determined in view of the resonant frequency of the combustion chamber 20 is emitted to the combustion chamber 20. Accordingly, since the microwave properly resonates in the combustion chamber 20 during the flame propagation, the propagation speed of the flame is effectively improved.

<Second Modified Example of Embodiment>

Figure 5:
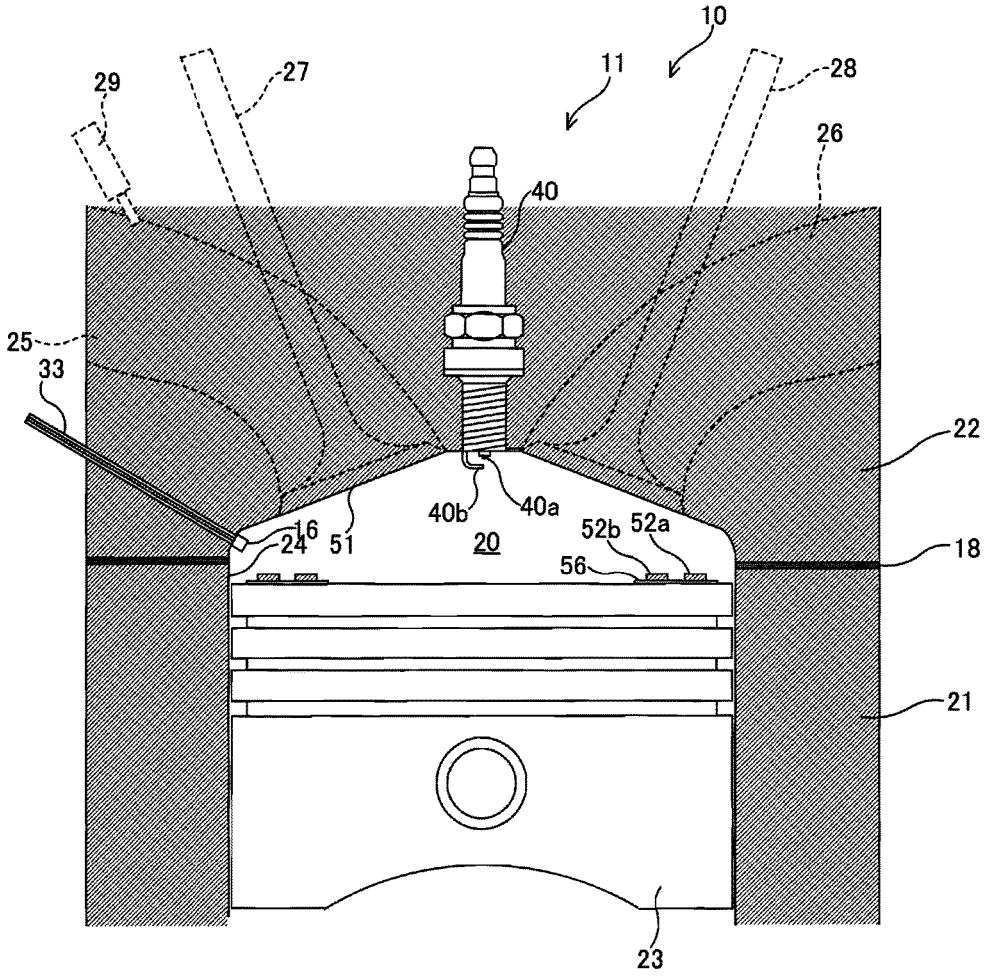
FIG. 5 is a vertical cross sectional view of an internal combustion engine according to a second modified example of the embodiment.

According to the second modified example of the present embodiment, the partitioning member that partitions the combustion chamber 20 is provided with a receiving antenna 52 in a shape of a ring that resonates with the microwave emitted to the combustion chamber 20 from the emission antenna 16. According to the second modified example, two receiving antennae 52*a* and 52*b* are provided on a part of the partitioning member wherein the part partitions a region close to a side wall of the combustion chamber 20. As shown in FIG. 5, the receiving antennae 52*a* and 52*b* are provided on a region close to a periphery of a top part of the piston 23. The receiving antennae 52*a* and 52*b* are provided on an insulation layer 56 laminated on a top surface of the piston 23.

INDUSTRIAL APPLICABILITY

The present invention is useful in relation to an internal combustion engine that promotes combustion of fuel air mixture in a combustion chamber utilizing an electromagnetic wave.

EXPLANATION OF REFERENCE NUMERALS

10 Internal Combustion Engine

11 Internal Combustion Engine Main Body

12 Ignition Device

13 Electromagnetic Wave Emission Device

16 Emission Antenna

20 Combustion Chamber

35 Control Device (Control Unit)

What is claimed is:

1. An internal combustion engine comprising:

an internal combustion engine main body formed with a combustion chamber;

an ignition device igniting fuel air mixture in the combustion chamber;

an electromagnetic wave emission device that emits an electromagnetic wave to the combustion chamber during a propagation of a flame following the ignition of the fuel air mixture; and a control unit configured to control a frequency of the electromagnetic wave emitted from the electromagnetic wave emission device in view of a resonant frequency of the combustion chamber in accordance with a load or rotation speed of the internal combustion engine main body.

2. The internal combustion engine as claimed in claim 1, wherein the control unit is configured to increase the frequency of the electromagnetic wave emitted from the electromagnetic wave emission device as the load or rotation speed of the internal combustion engine main body becomes higher.

* * * * *